United States Patent [19]

Malamood

[11] 4,396,336

[45] Aug. 2, 1983

[54] APPARATUS FOR FEEDING LIFTS OF LIMP SHEETS

[76] Inventor: Herman Malamood, 155 W. 68th St., New York, N.Y. 10023

[21] Appl. No.: 228,179

[22] Filed: Jan. 26, 1981

[51] Int. Cl.[3] ..... B65G 59/06

[52] U.S. Cl. ..... 414/115; 83/281; 221/251; 221/296; 270/95; 271/134; 414/131; 414/126

[58] Field of Search ..... 414/114, 115, 125, 126, 414/131, 786; 271/18, 134; 221/238, 247, 251, 296, 298; 83/281; 270/95

[56] References Cited

U.S. PATENT DOCUMENTS

| | | | |
|---|---|---|---|
| 2,589,600 | 3/1952 | Burkholder | 221/298 X |
| 2,731,131 | 1/1956 | Shannon | 221/296 X |
| 2,788,156 | 4/1957 | Cruzan | 221/251 |
| 3,215,014 | 11/1965 | Malamood et al. | 271/236 X |
| 3,327,873 | 6/1967 | Malamood et al. | 414/115 |
| 3,661,278 | 5/1972 | Hammerle | 414/126 |
| 3,834,582 | 9/1974 | Aspinwall | 221/248 |
| 4,072,090 | 2/1978 | Heisler | 221/298 X |

FOREIGN PATENT DOCUMENTS

| | | | |
|---|---|---|---|
| 167319 | 12/1950 | Austria | 221/298 |
| 477935 | 6/1929 | Fed. Rep. of Germany | 271/134 |

*Primary Examiner*—Leslie J. Paperner

*Attorney, Agent, or Firm*—Daniel Jay Tick

[57] ABSTRACT

A sheet magazine supports a stack of limp flexible sheets. The magazine has a bottom with a slot formed therethrough and spaced opposite first and second ends with an end feed gateway at the first end. A mechanical sheet separating and segregating device splits off and segregates each successive bottom-most lift of the stack from the remainder thereof and urges same through the gateway. The sheet separating and segregating device includes a stabber-separator movable toward the first end to support the stack at a selected distance above the bottom of the magazine and a pin extender movable toward the first end into the stack at a selected distance above the stabber-separator for segregating a bottom-most lift of the stack by being interposed in the stack above said lift. The stabber-separator is movable toward the second end of the bottom to a position spaced from the stack, thereby permitting the lift to drop to the bottom, and is movable back toward the first end directly under the pin extender. A lift extracting device includes a pusher movably mounted on the bottom and movable toward the first end to push the lift under the stabber-separator through the gateway. The pin extender is then movable toward the second end of the bottom to a position spaced from the stack whereby the stack again rests on the stabber-separator.

3 Claims, 11 Drawing Figures

APPARATUS FOR FEEDING LIFTS OF LIMP SHEETS

BACKGROUND OF THE INVENTION

The present invention relates to apparatus for feeding lifts of limp sheets. More particularly, the invention relates to apparatus for feeding lifts of paper sheets individually and successively from a stack of such sheets.

The sheets of the stack are limp flexible sheets of paper, or the like, of the type which would crumple, tear, and otherwise respond disadvantageously, if fed by a conventional mechanism.

Single sheets such as box blanks, single articles such as collapsed cartons, and single packages such as filled mailing envelopes, usually have enough resistance to bending to be fed individually from a magazine by a pusher blade, endless conveyor lugs, rotating friction wheels or movable suction cups. Double feeding in such apparatus is undesirable. In the present invention, however, the principal object is multiple feeding, since the apparatus is primarily intended for the purpose of simultaneously feeding a plurality of flimsy paper sheets in a unit, so that the unit may be passed through a punching, trimming, binding, stapling, stitching, gluing, or similar treatment.

The units or groups of limp, flexible, flimsy sheets are hereinafter referred to as "lifts". The sheets are usually of relatively small area such as are suitable for the printing and publishing art to be assembled into books, calendars, and the like. The lifts are not contained in a folded outer sheet, as in a signature, or bound at one edge, or provided with one extra long sheet usable for vacuum separation purposes, such packages being relatively easy to handle. The sheets in the lifts handled by the apparatus of the invention are identical in dimensions, unconnected, unbound, and without separators. This presents a difficult problem of accuracy in separation, segregation and withdrawal.

When the sheets are placed in an end feed magazine such as, for example, a gravity type, bottom feed hopper, the weight of the stack creates such friction that pusher blade feeds merely crumple the lift, vacuum separators are not effective and friction feeds affect only the bottom-most sheet and tend to crumple it.

The principal object of the invention is to provide apparatus for feeding lifts of limp sheets in which each successive lift in the magazine is mechanically and accurately separated from a stack thereof and is extracted from the magazine without crumpling of the sheets.

An object of the invention is to provide an apparatus for feeding limp sheet lifts in which each successive lift in the magazine is accurately and rapidly separated from the stack, and bodily rectilinearly moved out of the magazine.

Another object of the invention is to provide an automatic feeder capable of handling a large number of limp sheets per hour without danger of damaging the same and without danger of jamming of the feeder.

Still another object of the invention is to provide apparatus for depositing individual and successive lifts of limp paper sheets on a feed conveyor of an automatic punching, trimming, binding, stapling, stitching, gluing, or the like, device, the sheets in each lift being free of damage.

Yet another object of the invention is to provide apparatus of simple structure, which is inexpensive in manufacture and operation for feeding lifts of limp sheets.

Another object of the invention is to provide apparatus for feeding lifts of limp sheets, which apparatus is operable by one or two attendants, requires very little maintenance and is used with facility and convenience.

Still another object of the invention is to provide apparatus of simple structure for feeding lifts of limp sheets with rapidity, efficiency, effectiveness and reliability, without damage to the sheets.

BRIEF SUMMARY OF THE INVENTION

In accordance with the invention, apparatus for feeding lifts of identical limp flexible sheets from a stack of such sheets comprises a sheet magazine supporting a stack of limp flexible sheets and having a bottom with a slot formed therethrough. The bottom has spaced opposite first and second ends and an end feed gateway at the first of the ends. A mechanical sheet separating and segregating device splits off and segregates each successive bottom-most lift of the stack of the sheets from the remainder of the stack and urges same through the end feed gateway. The sheet separating and segregating device comprises a stabber-separator movable toward the first end to support the stack at a selected distance above the bottom of the sheet magazine and a pin extender movable toward the first end into the stack at a selected distance above the stabber-separator for segregating a bottom-most lift of the stack by being interposed in the stack above the lift. The stabber-separator is movable toward the second end to a position spaced from the stack thereby permitting the lift to drop to the bottom of the sheet magazine and movable back toward the first end directly under the pin extender. A lift extracting device comprises a pusher device movably mounted on the bottom of the sheet magazine and movable toward the first end to push the lift under the stabber-separator through the end feed gateway. The pin extender is then movable toward the second end to a position spaced from the stack whereby the stack again rests on the stabber-separator.

A trap door is movably mounted in operative proximity with the end feed gateway and is positionable to selectively block and clear the gateway.

A pin extender moving device is coupled to the pin extender for selectively moving the pin extender toward the first end of the bottom of the sheet magazine into the stack at the selected distance above the stabber-separator, and toward the second end of the bottom to a position spaced from the stack.

The stabber-separator comprises an elongated plate having a top surface, a bottom surface, a pair of sides, a back and a front tapered from the sides and from the top and bottom surfaces. The stabber-separator is mounted with the top and bottom surfaces substantially parallel to the bottom of the sheet magazine and the front pointed toward the first end of the bottom.

The plate of the stabber-separator further comprises a protrusion extending from the top surface thereof from the front to the back equidistantly from the sides and having a protruding top surface spaced from, and substantially parallel to, the upper surface of the plate.

A stabber-separator moving device is coupled to the stabber-separator for selectively moving the stabber-separator toward the first end of the bottom of the sheet magazine to support the stack at a selected distance above the bottom, and toward the second end of the bottom to a position spaced from the stack.

A pusher moving device is coupled to the pusher device for selectively moving the pusher device toward the first end of the bottom of the sheet magazine to push the lift under the stabber-separator through the end feed gateway and toward the second end of the bottom to a position spaced from the lift.

A trap door is movably mounted in operative proximity with the end feed gateway. A trap door moving device is coupled to the trap door for selectively moving the trap door toward the bottom of the sheet magazine to obstruct the end feed gateway and away from the bottom to free the end feed gateway.

A control system is coupled to the pin extender moving device, the stabber-separator moving device, the pusher moving device and the trap door moving device for controlling the operation of the pin extender moving device, the stabber-separator moving device, the pusher moving device and the trap door moving device for moving the pin extender, the stabber-separator, the pusher device and the trap door in predetermined directions at predetermined times in accordance with a predetermined cyclic program.

Each of the pin extender moving device, the stabber-separator moving device, the pusher moving device and the trap door moving device includes an air piston unit having a piston rod coupled to the pin extender, the stabber-separator, the pusher and the trap door, respectively. The control system comprises a source of compressed air, a plurality of air ducts extending from the source of compressed air to the pin extender air piston unit, the stabber-separator air piston unit, the pusher air piston unit and the trap door air piston unit. Each of a plurality of valves is connected in a corresponding one of the air ducts for selectively permitting and preventing the flow of air therethrough. Each of a plurality of cams is in operative proximity with a corresponding one of the valves. A motive device is coupled to the cams for rotating the cams to operate the valves in accordance with the program.

In accordance with the invention, a method of feeding lifts of identical limp flexible sheets from a stack of such sheets supported on a support comprises the steps of splitting off and segregating each successive bottom-most lift of the stack of sheets from the remainder of the stack and urging same away from the stack and off the support by supporting the stack at a first selected distance above the support and segregating a bottom-most lift of the stack at a second selected distance above the support greater than the first selected distance by separating the stack above the lift, discontinuing supporting the stack at the first distance so that the lift drops to the support from the first distance and rests on the support, resupporting the stack at the first distance, pushing the lift resting on the support away from the stack and off the support, and desegregating the stack so that the stack is again supported at the first distance.

BRIEF DESCRIPTION OF THE DRAWINGS

In order that the invention may be readily carried into effect, it will now be described with reference to the accompanying drawings, wherein.

DETAILED DESCRIPTION OF THE INVENTION

FIGS. 1 to 6 of U.S. Pat. No. 3,215,014, granted Nov. 2, 1965 to A. Malamood et al for Feeding Apparatus for Lifts of Limp Sheets and FIGS. 1 and 2 of U.S. Pat. No. 3,327,873, granted June 27, 1967 to H. Malamood et al for Apparatus and Method for Feeding Lifts of Limp Sheets show an automatic treatment machine, exemplary of the type of machine in which the feeding apparatus for lifts of limp sheets of the present invention is intended to be used. All of the machine, except the limp sheet lift feeding apparatus described and claimed herein, is shown in the aforedescribed two patents. In each of these patents, the lift is fed to an endless conveyor which moves it to a treatment area where desired operations are performed on it.

The apparatus of the invention feeds lifts of identical limp flexible sheets such as, for example, paper, or the like, from a stack 1 of such sheets (FIGS. 1 and 5 to 9).

Figure 1:
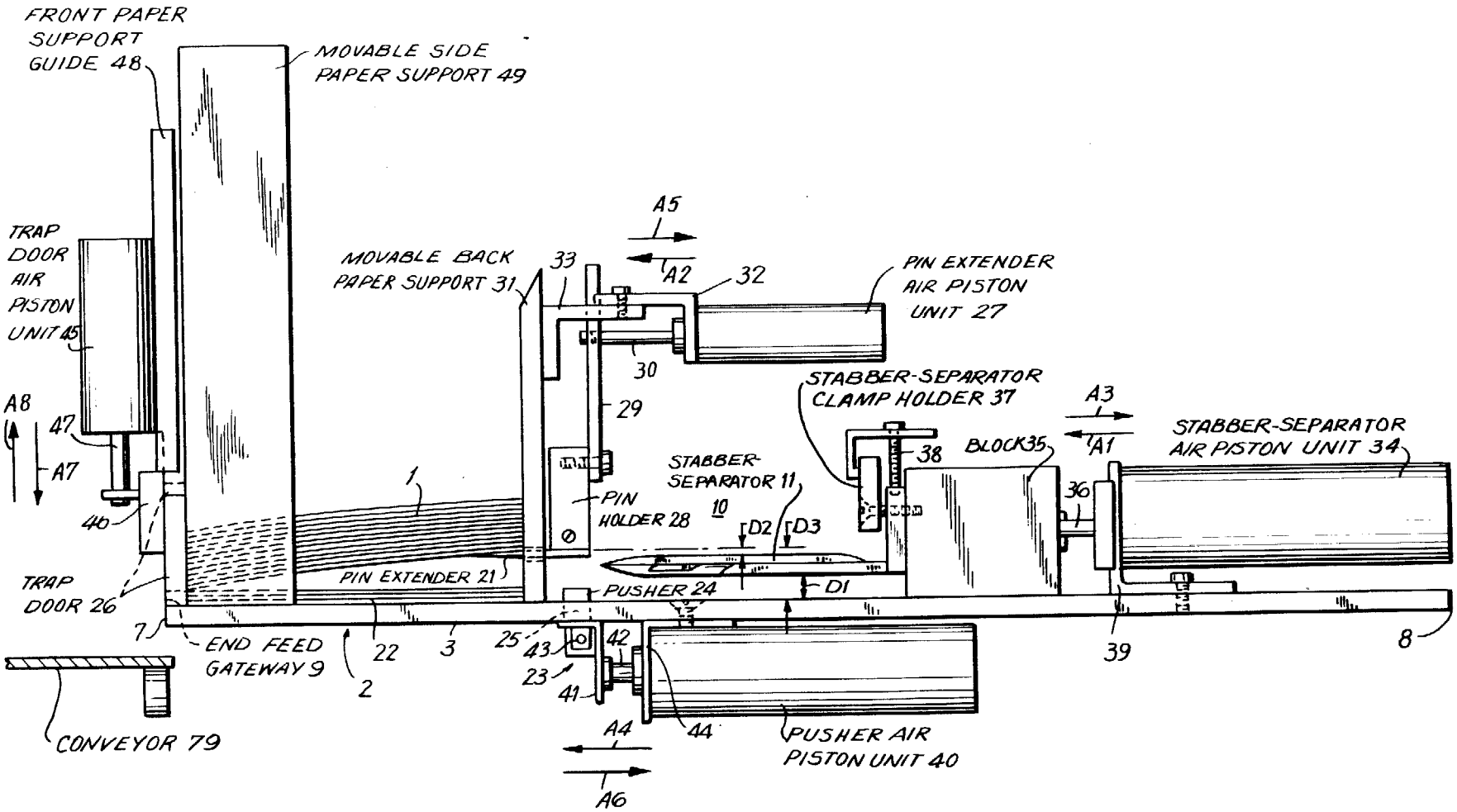
FIG. 1 is a schematic diagram of an embodiment of the apparatus of the invention.
Figure 11:
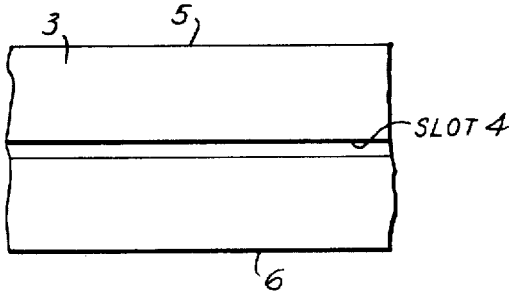
FIG. 11 is a bottom view of part of the sheet magazine of the embodiment of FIGS. 1 and 5 to 9.

As shown in FIGS. 1 and 5 to 9, the apparatus of the invention comprises a sheet magazine 2 supporting the stack 1 of limp flexible sheets and having a bottom 3. The bottom 3 of the magazine 2 has a slot 4 formed therethrough and extending lengthwise thereof, equidistant from the sides 5 and 6 thereof, as shown in FIG. 11. The bottom 3 of the magazine 2 has spaced opposite first and second ends 7 and 8 (FIGS. 1 and 5 to 9). An end feed gateway 9 is provided at the first end 7 of the bottom 3 of the sheet magazine 2, as shown in FIG. 1.

A mechanical sheet separating and segregating device, generally indicated by the reference numeral 10 in FIGS. 1 and 5 to 9, is provided for splitting off and segregating each successive bottom-most lift of the stack 1 of limp flexible sheets from the remainder of the stack and urging said lift through the end feed gateway 9. The sheet separating and segregating device 10 comprises a stabber-separator 11 (FIGS. 1 to 9) movable in a direction, indicated by an arrow A1 in FIG. 1, toward the first end 7 of the bottom 3 of the sheet magazine 2 to support the stack 1 at a selected distance D1 above the bottom 3, as shown in FIG. 1.

Figure 3:
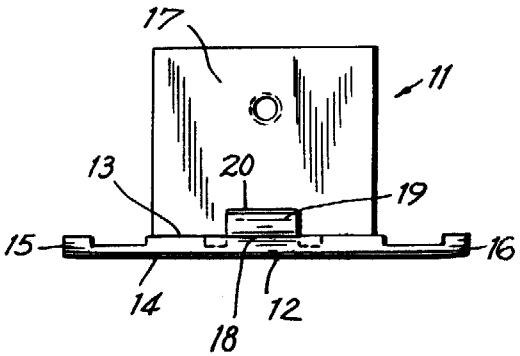
FIG. 3 is a front view, taken along the lines III—III, of FIG. 2.
Figure 2:
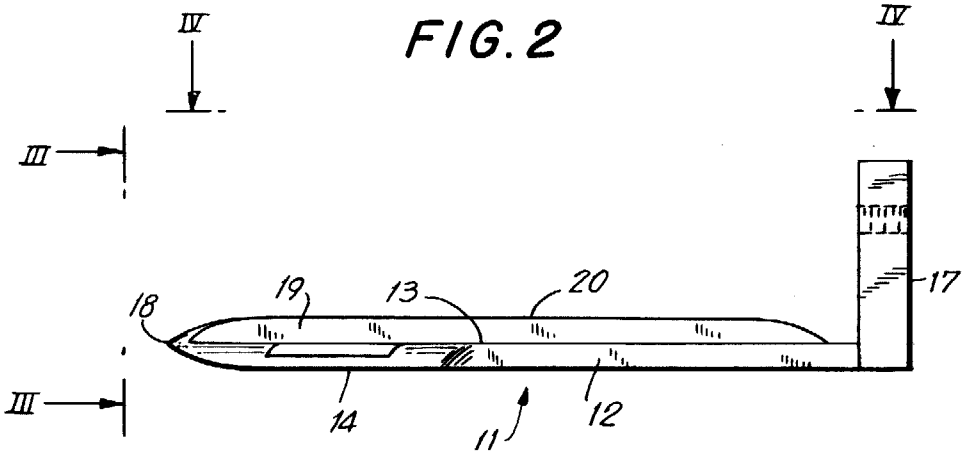
FIG. 2 is a side view of an embodiment of the stabber-separator of the apparatus of the invention.
Figure 4:
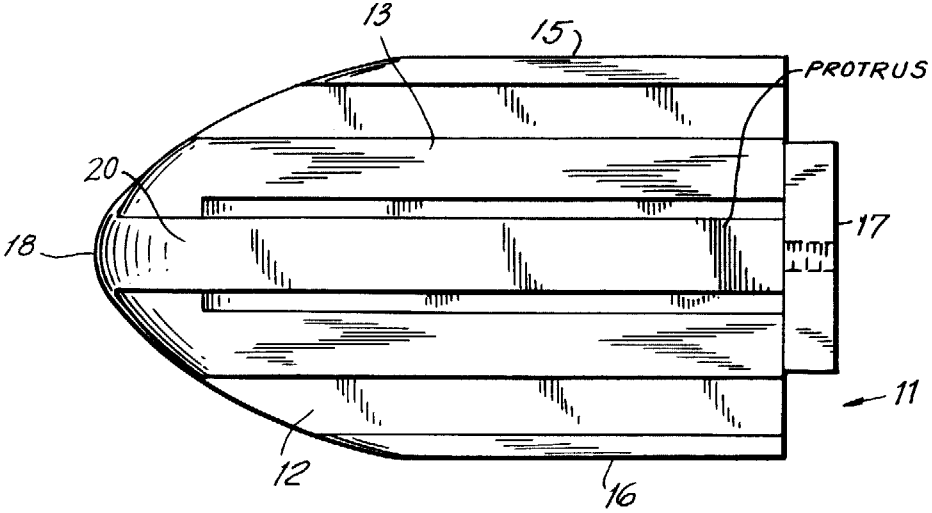
FIG. 4 is a top view, taken along the lines IV—IV, of FIG. 2.

The stabber-separator 11, as shown in FIGS. 2 to 4, comprises an elongated plate 12 having a top surface 13 and a bottom surface 14 (FIGS. 2 and 3). The stabber-separator 11 also has a pair of sides 15 and 16 (FIGS. 3 and 4) and a back 17. The stabber-separator 11 has a front 18 tapered and slightly rounded from the sides 15 and 16, as shown in FIG. 4, and from the top and bottom surfaces 13 and 14, as shown in FIG. 2. The plate 12 thus has a tapered, rounded, leading edge or front 18, which facilitates its entry between the sheets of the stack 1.

A protrusion 19 extends from the top surface 13 of the plate 12 of the stabber-separator 11 (FIGS. 2 to 4), from the front 18 to the back 17, as shown in FIGS. 2 and 4, and equidistantly from the sides 15 and 16, as shown in FIGS. 3 and 4. The protrusion 19 has a protruding top surface 20 spaced from, and substantially parallel to, the upper surface 13 of the plate 12.

The stabber-separator 11 is mounted with its top and bottom surfaces 13 and 14 substantially parallel to the bottom 3 of the sheet magazine 2 and with its front 18 pointed toward the first end 7 of said bottom, as shown in FIGS. 1 and 5 to 9, in the direction of the arrow A1 of FIG. 1.

The protrusion 19 provides a concentrated, high-friction support surface for the stack 1 and thereby stabilizes said stack in position.

Figure 5:
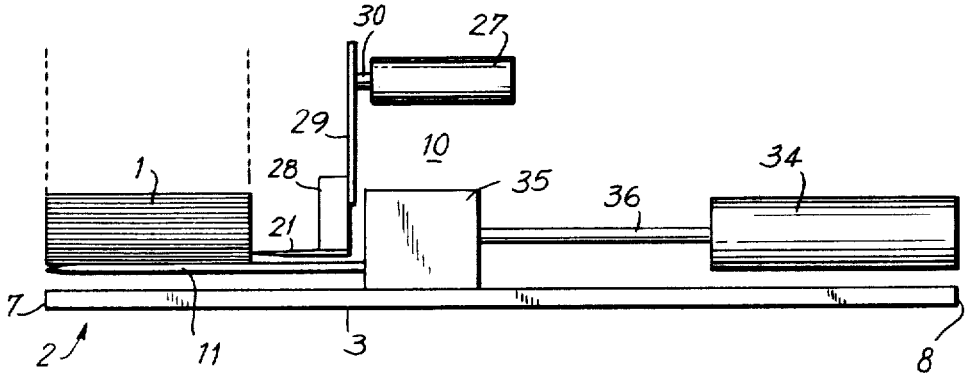
FIG. 5 is a schematic diagram of an embodiment of the apparatus of the invention at a first time of its operating cycle.
Figure 6:
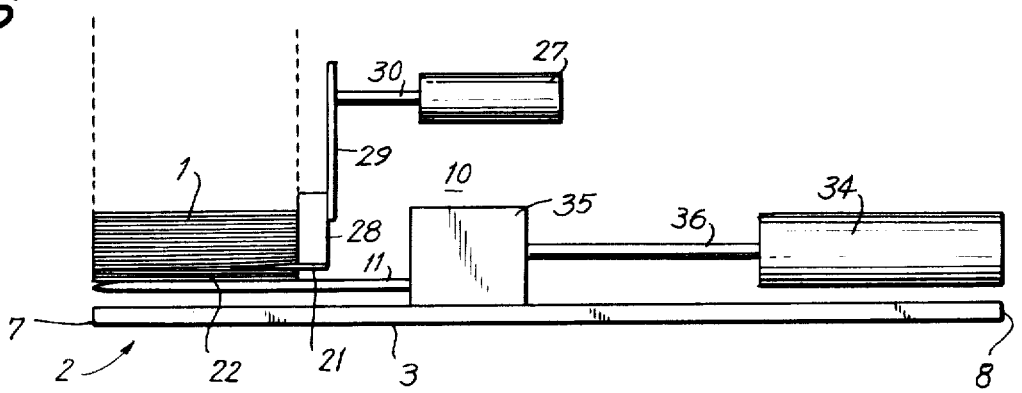
FIG. 6 is a schematic diagram of the embodiment of FIG. 5 of the apparatus of the invention at a second time of its operating cycle.
Figure 7:
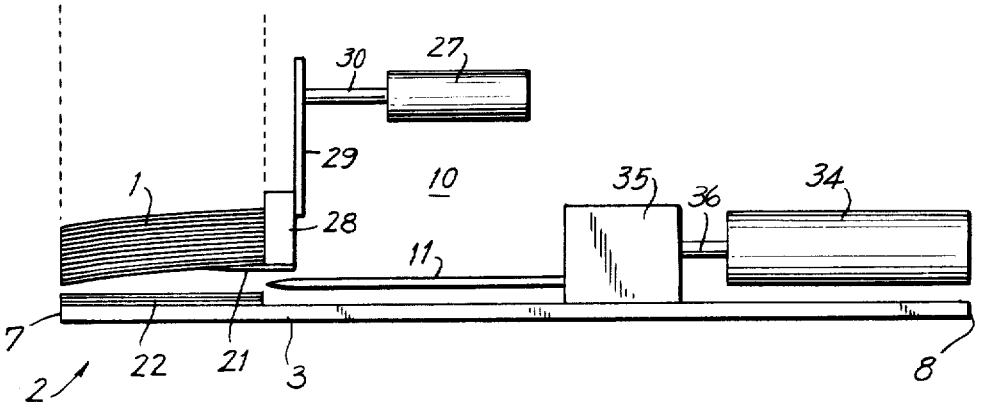
FIG. 7 is a schematic diagram of the embodiment of FIG. 5 of the apparatus of the invention at a third time of its operating cycle.

The mechanical sheet separating and segregating device 10 further comprises a pin extender 21 (FIGS. 1 and 5 to 9) movable in a direction, indicated by an arrow A2 in FIG. 1, toward the first end 7 of the bottom 3 of the magazine 2 into the stack 1 at a selected distance D2 above the stabber-separator 11 (FIG. 1), which is equal to a selected distance D3 above said bottom (FIG. 1). The pin extender 21 functions to segregate a bottom-most lift 22 (FIGS. 1 and 6 to 9) of the stack 1 by being interposed in said stack above said lift (FIG. 6). The stabber-separator 11 is movable in a direction, indicated by an arrow A3 in FIG. 1, toward the second end 8 of the bottom 3 of the magazine 2 to a position spaced from the stack 1, as shown in FIGS. 1 and 7, thereby permitting the lift 22 to drop to the bottom of the magazine. The stabber-separator 11 is then movable back toward the first end 7 of the bottom 3, in the direction of the arrow A1, directly under the pin extender 21, as shown in FIGS. 8 and 9.

A lift extracting device, generally indicated by reference numeral 23 (FIGS. 1, 8 and 9), comprises a pusher or pusher device 24 (FIGS. 1, 8 and 9) movably mounted on the bottom 3 of the sheet magazine 2 via a support part 25 (FIG. 1) extending through, and slidable in, the slot 4 through said bottom. The pusher device 24 is movable in a direction, indicated by an arrow A4 in FIG. 1, toward the first end 7 of the bottom 3 to push the lift 22, which is under the stabber-separator 11, through the end feed gateway 9 (FIG. 1). The pin extender 21 is then movable in a direction, indicated by an arrow A5 in FIG. 1, toward the second end 8 of the bottom 3 of the magazine 2 to a position spaced from the stack 1 whereby said stack again rests on the stabber-separator 11, as shown in FIG. 5.

Figure 8:
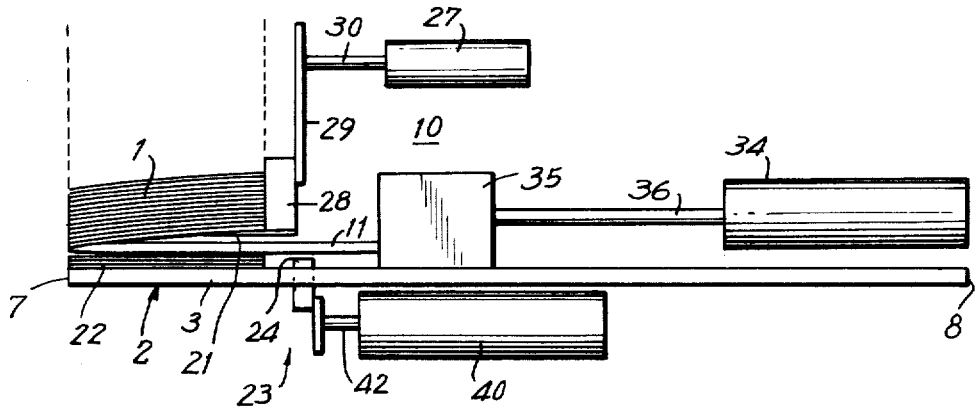
FIG. 8 is a schematic diagram of the embodiment of FIG. 5 of the apparatus of the invention at a fourth time of its operating cycle.
Figure 9:
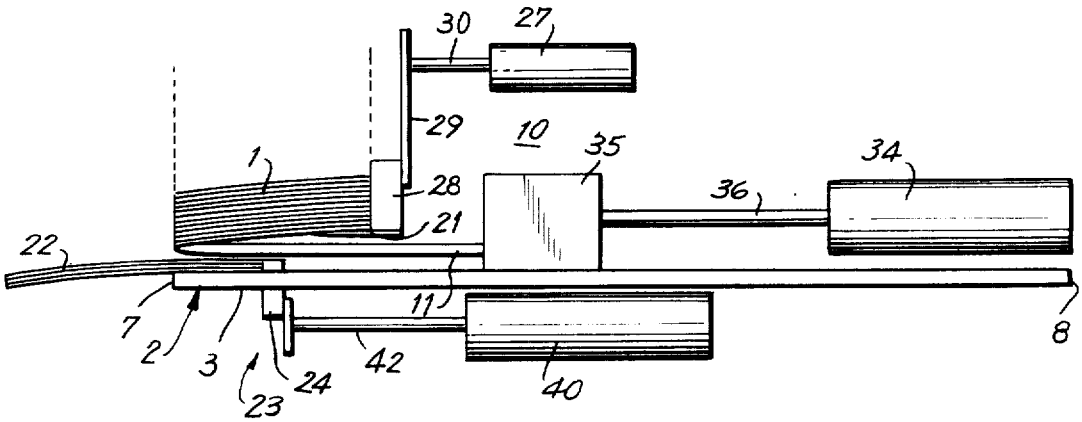
FIG. 9 is a schematic diagram of the embodiment of FIG. 5 of the apparatus of the invention at a fifth time of its operating cycle with the pusher device in operation.

After the pusher 24 has pushed the lift 22 through the end feed gateway 9, as shown in FIG. 9, said pusher is moved back, in a direction, indicated by an arrow A6 in FIG. 1, toward the second end 8 of the bottom 3 to its position shown in FIGS. 1 and 8.

The apparatus of the invention further comprises a trap door 26 movably mounted in operative proximity with the end feed gateway 9, as shown in FIG. 1, and positionable to selectively block and clear said gateway. Thus, when the trap door 26 is moved in a direction, indicated by an arrow A7 in FIG. 1, it blocks the end feed gateway 9, and is illustrated in solid lines in FIG. 1. When the trap door 26 is moved in a direction, indicated by an arrow A8 in FIG. 1, it clears the end feed gateway 9, and is shown in broken lines in FIG. 1.

A pin extender moving device of any suitable type such as, for example, a pin extender air piston unit 27 (FIGS. 1 and 5 to 10) is coupled to the pin extender 21 via a coupling arrangement which includes a pin holder 28 affixed to an arm 29, which arm is affixed to, and moves with, the piston rod 30 of said pin extender air piston unit (FIGS. 1 and 6 to 9). The arm 29 extends at right angles to the piston rod 30. The pin extender air piston unit 27 is affixed to a movable back paper support 31 of the sheet magazine 2 via a pair of angle members 32 and 33, as shown in FIG. 1.

The pin extender air piston unit 27 selectively moves the pin extender 21, in the direction of the arrow A2 (FIG. 1), toward the first end 7 of the bottom 3 of the sheet magazine 2, into the stack 1 at the selected distance D2 above the stabber-separator 11 and at the selected distance D3 above said bottom, as shown in FIGS. 1 and 6 to 9, and, in the direction of the arrow A5 (FIG. 1), toward the second end 8 of said bottom to a position spaced from said stack, as shown in FIG. 5.

A stabber-separator moving device of any suitable type such as, for example, a stabber-separator air piston unit 34 (FIGS. 1 and 5 to 10) is coupled to the stabber-separator 11 via a coupling arrangement which includes a block 35 (FIGS. 1 and 5 to 9) affixed to the end of the piston rod 36 of said stabber-separator air piston unit and movable with said piston rod. A stabber-separator clamp holder 37 (FIG. 1) adjustably secures the stabber-separator 11 to the block 35. The clamp holder 37 includes an adjusting screw 38 (FIG. 1) for selectively adjusting the position of the stabber-separator 11 relative to the bottom 3 of the magazine 2, thereby selectively adjusting the selected distance D1 of said stabber-separator from said bottom.

The stabber-separator air piston unit 34 is mounted on the oversurface of the bottom 3 of the magazine 2 via an angle member 39 (FIG. 1) and selectively moves the stabber-separator 11, in the direction of the arrow A1 (FIG. 1), toward the first end 7 of said bottom to support the stack 1 at the selected distance D1 above said bottom, as shown in FIG. 6, and, in the direction of the arrow A3 (FIG. 1), toward the second end 8 of said bottom to a position spaced from said stack, as shown in FIGS. 1 and 7.

A pusher moving device of any suitable type such as, for example, a pusher air piston unit 40 (FIGS. 1 and 8 to 10) is coupled to the pusher 24 via the support part 25, which is adjustably affixed to an angle member 41, which in turn is affixed to, and movable with, the piston rod 42 of said pusher air piston unit. The pusher 24 is adjustable in its position relative to the bottom 3 of the magazine 2 via an adjusting screw 43, shown in FIG. 1. This permits the distance that the pusher 24 extends above the bottom 3 to be selectively adjusted. The pusher air piston unit 40 is mounted on the undersurface of the bottom 3 via an angle member 44 (FIG. 1).

The pusher air piston unit 40 selectively moves the pusher or pusher device 24, in the direction of the arrow A4 (FIG. 1), toward the first end 7 of the bottom 3 of the sheet magazine 2 to push the lift 22, under the stabber-separator 11, through the end feed gateway 9, as shown in FIG. 9, and, in the direction of the arrow A6

(FIG. 1), toward the second end 8 of said bottom to a position spaced from said lift, as shown in FIGS. 1 and 8.

A trap door moving device of any suitable type such as, for example, a trap door air piston unit 45 (FIGS. 1 and 10) is coupled to the trap door 26 via an arm 46 affixed to said trap door and secured to the end of the piston rod 47 of said trap door air piston unit (FIG. 1) and movable therewith. The trap door air piston unit 45 is mounted on a front paper support guide 48 of the magazine 2 (FIG. 1).

The trap door air piston unit 45 selectively moves the trap door 26, in the direction of the arrow A7 (FIG. 1), toward the bottom 3 of the sheet magazine 2 to block the end feed gateway 9, as shown by solid lines in FIG. 1, and away from said bottom, in the direction of the arrow A8 (FIG. 1), to clear said end feed gateway, as shown by broken lines in FIG. 1.

The magazine 2 has a movable side paper support 49 (FIG. 1) to maintain the stack 1 in position.

Figure 10:
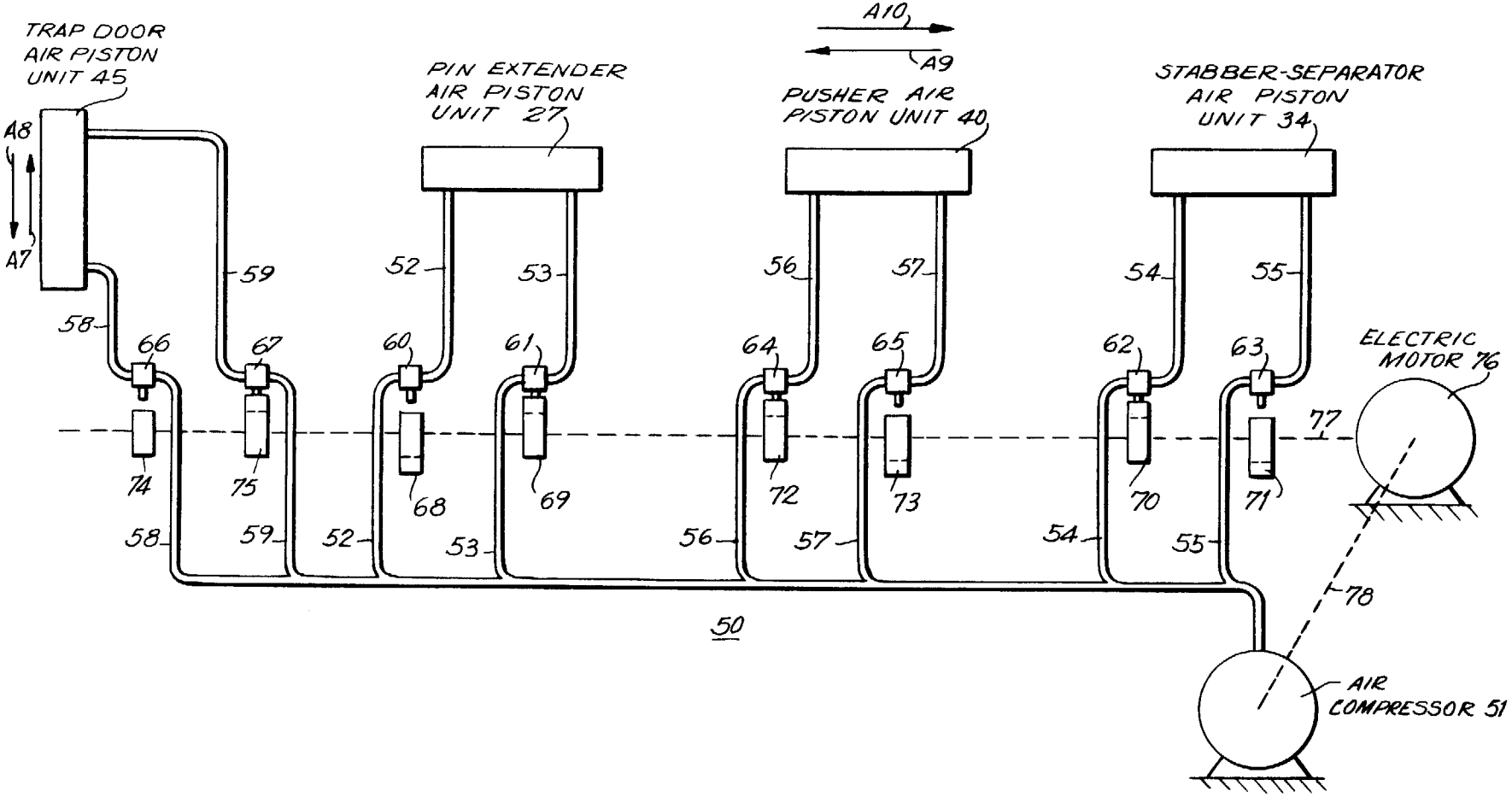
FIG. 10 is a schematic diagram of an embodiment of a control system of the apparatus of the invention.

The pin extender moving device, the stabber-separator moving device, the pusher moving device and the trap door moving device are coupled in a control system generally indicated by reference numeral 50 and shown in FIG. 10. The control system 50 controls the operation of the pin extender moving device, the stabber-separator moving device, the pusher moving device and the trap door moving device to move the pin extender 21, the stabber-separator 11, the pusher 24 and the trap door 26 in predetermined directions at predetermined times in accordance with a predetermined cyclic program, as hereinbefore and hereinafter explained.

The control system, as shown in FIG. 10, includes a source of compressed air or air compressor 51 of any suitable type. A plurality of air ducts extend from the air compressor 51 to the pin extender air piston unit 27, the stabber-separator air piston unit 34, the pusher air piston unit 40 and the trap door air piston unit 45. Thus, as shown in FIG. 10, air ducts 52 and 53 extend from the air compressor 51 to the pin extender air piston unit 27, air ducts 54 and 55 extend from said air compressor to the stabber-separator air piston unit 34, air ducts 56 and 57 extend from said air compressor to the pusher air piston unit 40, and air ducts 58 and 59 extend from said air compressor to the trap door air piston unit 45.

A plurality of valves 60, 61, 62, 63, 64, 65, 66 and 67 (FIG. 10) are connected in the air ducts 52, 53, 54, 55, 56, 57, 58 and 59, respectively (FIG. 10), to selectively permit and prevent the flow of air through said ducts in accordance with the predetermined program. A plurality of cams 68, 69, 70, 71, 72, 73, 74 and 75 are positioned in operative proximity with the valves 60, 61, 62, 63, 64, 65, 66 and 67, respectively.

An electric motor 76 of any suitable type is coupled to, and rotates, the cams 68 to 75 to operate the valves 60 to 67 in accordance with the predetermined program. The cams 68 to 75 are mounted on a shaft 77 which is driven by the motor 76 and is shown by broken lines in FIG. 10. The air compressor 51 is coupled to, and driven by, the motor 76 via a shaft 78, shown by broken lines in FIG. 10.

In FIG. 10, the arrows A7 and A8 are the same as those in FIG. 1, the arrow A9 is the same as the arrows A1, A2 and A4 in FIG. 1, and the arrow A10 is the same as the arrows A3, A5 and A6 in FIG. 1. The cams 68 to 75 are shown in FIG. 10 in their positions which cause the placing of the pin extender 21, the stabber-separator 11, the pusher 24 and the trap door 45 in their positions shown in FIGS. 1 and 7.

The basic method of the invention for feeding lifts of identical limp flexible sheets from a stack of such sheets supported on a support comprises the steps of splitting off and segregating each successive bottom-most lift of the stack of sheets from the remainder of the stack and urging same away from the stack and off the support by supporting the stack at a first selected distance above the support and segregating a bottom-most lift of the stack at a second selected distance above the support greater than the first selected distance by separating the stack above the lift, discontinuing supporting the stack at the first distance so that the lift drops to the support from the first distance and rests on the support, resupporting the stack at the first distance, pushing the lift resting on the support away from the stack and off the support, and desegregating the stack so that the stack is again supported at the first distance.

The apparatus of the invention operates in the following manner.

At the time of the cycle, illustrated in FIG. 5, or in the first position and the first time of the cycle, the valves 60, 63, 64 and 67 (FIG. 10) are closed by the corresponding cams 68, 71, 72 and 75, respectively, and the valves 61, 62, 65 and 66 are opened by the corresponding cams 69, 70, 73 and 74, respectively. Thus, the pin extender 21 is spaced from the stack 1, the stabber-separator 11 is positioned under the stack and supports the entire stack, the pusher 24 (not shown in FIG. 5) is spaced from the stack, and the trap door 26 (not shown in FIG. 5) is closed, thereby closing or blocking the end feed gateway 9.

At the next-successive, or second, time of the cycle, illustrated in FIG. 6, or in the second position, the valves 61, 63, 64 and 67 (FIG. 10) are closed by the corresponding cams 69, 71, 72 and 75, respectively, and the valves 60, 62, 65 and 66 are opened by the corresponding cams 68, 70, 73 and 74, respectively. Thus, the pin extender 21 is interposed in the stack 1, thereby segregating the bottom-most lift of the stack at the distance D3 above the bottom 3 of the sheet magazine 2, the stabber-separator 11 remains positioned under the stack and still supports the entire stack, the pusher 24 (not shown in FIG. 6) remains spaced from the stack, and the trap door 26 (not shown in FIG. 6) remains closed, thereby keeping the end feed gateway 9 blocked or closed.

At the next-successive, or third, time of the cycle, illustrated in FIG. 7, or in the third position, the valves 61, 62, 64 and 67 (FIG. 10) are closed by the corresponding cams 69, 70, 72 and 75, respectively, and the valves 60, 63, 65 and 66 are opened by the corresponding cams 68, 71, 73 and 74, respectively. Thus, the pin extender 21 remains interposed in the stack 1, thereby retaining the segregation of the bottom-most lift of the stack at the distance D3 above the bottom 3 of the sheet magazine 2, the stabber-separator 11 is moved away from the stack and is spaced therefrom so that it no longer supports the stack and the bottom-most lift 22 drops to the bottom 3 of said magazine, the pusher 24 (not shown in FIG. 7) remains spaced from the stack, and the trap door 26 (not shown in FIG. 7) remains closed, thereby keeping the end feed gateway 9 blocked.

At the next-successive, or fourth, time of the cycle, illustrated in FIG. 8, or in the fourth position, the valves 61, 63, 64 and 67 (FIG. 10) are closed by the corresponding cams 69, 71, 72 and 75, respectively, and the valves 60, 62, 65 and 66 are opened by the corresponding cams 68, 70, 73 and 74, respectively. Thus, the pin extender 21 remains interposed in the stack 1, thereby retaining the remainder of the stack at the distance D3 above the bottom 3 of the sheet magazine 2, the stabber-separator 11 is positioned under the pin extender, so that it supports the stack less the bottom-most lift 22, and isolates said bottom-most lift, the pusher 24 remains spaced from the stack and the trap door 26 (not shown in FIG. 8) remains closed, thereby keeping the end feed gateway 9 blocked.

At the next-successive, or fifth or last, time of the cycle, illustrated in FIG. 9, or in the fifth position, the valves 61, 63, 65 and 66 (FIG. 10) are closed by the corresponding cams 69, 71, 73 and 74, respectively, and the valves 60, 62, 64 and 67 are opened by the corresponding cams 68, 70, 72 and 75, respectively. Thus, the pin extender 21 remains interposed in the stack 1, thereby continuing to retain the remainder of the stack at the distance D3 above the bottom 3 of the sheet magazine 2, the stabber-separator remains positioned under the pin extender, so that it continues to support the stack less the bottom-most lift 22, and continues to isolate said bottom-most lift, the pusher 24 is moved toward the end feed gateway 9, contacts the lift 22 and pushes said lift toward and through said end feed gateway and the trap door 26 is opened, thereby clearing said gateway and permitting said lift to pass through said gateway onto an endless conveyor 79 (FIG. 1) of a machine. As each lift is fed through the end feed gateway 9, it is deposited on the conveyor 79 which then moves it to a desired machine operation in the manner of the machines described in the aforedescribed U.S. Pat. Nos. 3,215,014 and 3,327,873.

The next cycle then commences, with the valves 60, 63, 64 and 67 (FIG. 10) being closed and the valves 61, 62, 65 and 66 being opened by the appropriate cams, so that the pin extender 21 is withdrawn from the stack 1 and is positioned spaced therefrom so that the stack is desegregated, the stabber-separator remains positioned under the stack so that it then supports the entire new stack, the pusher 24 is moved away from the end feed gateway 9 and is positioned spaced from the stack, and the trap door 26 is closed to block the gateway.

While the invention has been described by means of a specific example and in a specific embodiment, I do not wish to be limited thereto, for obvious modifications will occur to those skilled in the art without departing from the spirit and scope of the invention.

I claim:

1. Apparatus for feeding lifts of identical limp flexible sheets from a stack of such sheets, said apparatus comprising sheet magazine means supporting a stack of limp flexible sheets and having a bottom with a slot formed therethrough, said bottom having spaced opposite first and second ends, and an end feed gateway at the first of said ends;

mechanical sheet separating and segregating means for splitting off and segregating each successive bottom-most lift of said stack of said sheets from the remainder of said stack and urging same through the end feed gateway, said sheet separating and segregating means comprising stabber-separator means movable toward said first end to support said stack at a selected distance above said bottom of said sheet magazine means and pin extender means movable toward said first end into said stack at a selected distance above said stabber-separator means for segregating a bottom-most lift of said stack by being interposed in said stack above said lift, said stabber-separator means comprising an elongated plate having a top surface, a bottom surface, a pair of sides, a back and a front tapered from said sides and from said top and bottom surfaces, said stabber-separator means being mounted with said top and bottom surfaces substantially parallel to said bottom of said sheet magazine means and said front pointed toward said first end of said bottom, said plate of said stabber-separator means further comprising a protrusion extending from said top surface thereof from said front to said back equidistantly from said sides and having a protruding top surface spaced from and substantially parallel to said upper surface of said plate, said stabber-separator means being movable toward said second end to a position spaced from said stack thereby permitting said lift to drop to said bottom of said sheet magazine means and movable back toward said first end directly under said pin extender means; and lift extracting means comprising a pusher device movably mounted on said bottom of said sheet magazine means and movable toward said first end to push the lift under said stabber-separator means through said end feed gateway, said pin extender means then being movable toward said second end to a position spaced from said stack whereby said stack again rests on said stabber-separator means.

2. Apparatus for feeding lifts of identical limp flexible sheets from a stack of such sheets, said apparatus comprising sheet magazine means supporting a stack of limp flexible sheets and having a bottom with a slot formed therethrough, said bottom having spaced opposite first and second ends, and an end feed gateway at the first of said ends;

mechanical sheet separating and segregating means for splitting off and segregating each successive bottom-most lift of said stack of said sheets from the remainder of said stack and urging same through the end feed gateway, said sheet separating and segregating means comprising stabber-separator means movable toward said first end to support said stack at a selected distance above said bottom of said sheet magazine means and pin extender means movable toward said first end into said stack at a selected distance above said stabber-separator means for segregating a bottom-most lift of said stack by being interposed in said stack above said lift, said stabber-separator means being movable toward said second end to a position spaced from said stack thereby permitting said lift to drop to said bottom of said sheet magazine means and movable back toward said first end directly under said pin extender means;

lift extracting means comprising a pusher device movably mounted on said bottom of said sheet magazine means and movable toward said first end to push the lift under said stabber-separator means through said end feed gateway, said pin extender means then being movable toward said second end to a position spaced from said stack whereby said stack again rests on said stabber-separator means;

pin extender moving means coupled to said pin extender means for selectively moving said pin extender means toward the first end of the bottom of said sheet magazine means into said stack at said selected distance above said stabber-separator means and toward said second end of said bottom to a position spaced from said stack;

stabber-separator moving means coupled to said stabber-separator means for selectively moving said stabber-separator means toward said first end of said bottom of said sheet magazine means to support said stack at a selected distance above said bottom and toward said second end of said bottom to a position spaced from said stack;

pusher moving means coupled to said pusher device for selectively moving said pusher device toward said first end of said bottom of said sheet magazine means to push the lift under said stabber-separator means through said end feed gateway and toward said second end of said bottom to a position spaced from said lift;

a trap door movably mounted in operative proximity with said end feed gateway;

trap door moving means coupled to said trap door for selectively moving said trap door toward said bottom of said sheet magazine means to block said end feed gateway and away from said bottom to free said end feed gateway, each of said pin extender moving means, said stabber-separator moving means, said pusher moving means and said trap door moving means including an air piston unit having a piston rod coupled to said pin extender means, said stabber-separator means, said pusher means and said trap door, respectively; and control means coupled to said pin extender moving means, said stabber-separator moving means, said pusher moving means and said trap door moving means for controlling the operation of said pin extender moving means, said stabber-separator moving means, said pusher moving means and said trap door moving means for moving said pin extender means, said stabber-separator means, said pusher device and said trap door in predetermined directions at predetermined times in accordance with a predetermined cyclic program, said control means comprising a source of compressed air, a plurality of air ducts extending from said source of compressed air to said pin extender air piston unit, said stabber-separator air piston unit, said pusher air piston unit and said trap door air piston unit, a plurality of valves each connected in a corresponding one of said air ducts for selectively permitting and preventing the flow of air therethrough, a plurality of cams, each in operative proximity with a corresponding one of said valves, and motive means coupled to said cams for rotating said cams to operate said valves in accordance with said program.

3. Apparatus for feeding lifts of identical limp flexible sheets from a stack of such sheets, said apparatus comprising sheet magazine means supporting a stack of limp flexible sheets and having a bottom with a slot formed therethrough, said bottom having spaced opposite first and second ends, and an end feed gateway at the first of said ends;

mechanical sheet separating and segregating means for splitting off and segregating each successive bottom-most lift of said stack of said sheets from the remainder of said stack and urging same through the end feed gateway, said sheet separating and segregating means comprising stabber-separator means movable toward said first end to support said stack at a selected distance above said bottom of said sheet magazine means and pin extender means movable toward said first end into said stack at a selected distance above said stabber-separator means for segregating a bottom-most lift of said stack by being interposed in said stack above said lift, said stabber-separator means being movable toward said second end to a position spaced from said stack thereby permitting said lift to drop to said bottom of said sheet magazine means and movable back toward said first end directly under said pin extender means, said stabber-separator means comprising an elongated plate having a top surface, a bottom surface, a pair of sides, a back and a front tapered from said sides and from said top and bottom surfaces, said stabber-separator means being mounted with said top and bottom surfaces substantially parallel to said bottom of said sheet magazine means and said front pointed toward said first end of said bottom, said plate of said stabber-separator means further comprising a protrusion extending from said top surface thereof from said front to said back equidistantly from said sides and having a protruding top surface spaced from and substantially parallel to said upper surface of said plate;

lift extracting means comprising a pusher device movably mounted on said bottom of said sheet magazine means and movable toward said first end to push the lift under said stabber-separator means through said end feed gateway, said pin extender means then being movable toward said second end to a position spaced from said stack whereby said stack again rests on said stabber-separator means; and a trap door movably mounted in operative proximity with said end feed gateway and positionable to selectively block and clear said gateway.

* * * * *